United States Patent [19]

Moss

[11] Patent Number: 4,580,307

[45] Date of Patent: Apr. 8, 1986

[54] WALL WASHING PAD HOLDER

[75] Inventor: Theron C. Moss, Cleveland, Tenn.

[73] Assignee: Seco Industries, Inc., Cleveland, Tenn.

[21] Appl. No.: 636,734

[22] Filed: Aug. 1, 1984

[51] Int. Cl.[4] ..... A47L 13/254

[52] U.S. Cl. ..... 15/147 R; 15/144 A; 15/228; 15/261

[58] Field of Search ..... 15/147 R, 147 A, 147 B, 15/154, 228, 229, 229 B, 229 BC, 229 BP, 229 BW, 261, 244 A, 144 A

[56] References Cited

U.S. PATENT DOCUMENTS

| | | | |
|---|---|---|---|
| 2,777,148 | 1/1957 | Belsky et al. | 15/228 |
| 3,395,415 | 8/1968 | Leland | 15/229 B X |
| 3,704,480 | 12/1972 | Whitaker | 15/244 A X |
| 3,792,505 | 2/1974 | Saltzstein | 15/147 A X |

*Primary Examiner*—Edward L. Roberts

*Attorney, Agent, or Firm*—Renner, Otto, Boisselle & Lyon

[57] ABSTRACT

Pad holder includes a generally flat rectangular mounting plate or head having a front or bottom side to which the pad is attached and a top or back side having a plurality of spaced-apart ribs thereon terminating in a common plane substantially parallel to the planar bottom side of the mounting plate to provide for the transfer of pressure from the wringer plates of a conventional mop wringer to the pad through the ribs to squeeze out the pad. The ribs provide for the recess mounting of a hinge member to the back side of the mounting plate. The hinge member permits a handle socket connected thereto to be pivoted up against the back side of the mounting plate below the tops of the ribs where it will not interfere with the pressure engagement of the wringer plates with the ribs and pad, respectively, during wringing out of the pad. The ribs are preferably open or slotted at least at one end thereof to permit water to flow freely between the ribs and back into a mop bucket or the like as the pad is being wrung out.

13 Claims, 5 Drawing Figures

WALL WASHING PAD HOLDER

BACKGROUND OF THE INVENTION

This invention relates generally as indicated to a wall washing pad holder and more particularly to certain improvements in such holders which permit a pad or the like mounted on the holder head to be wrung out using a conventional mop wringer without having to remove the pad from the holder head.

There are basically two different types of mop wringers in widespread use. One is commonly known as a side press wringer which includes front and back plates that are relatively movable toward and away from each other to wring out a mop swab inserted therebetween. The other is commonly referred to as a down press wringer and includes a pair of top pressure plates that are flipped over after the mop swab has been inserted into the wringer to push the mop swab against the bottom of the wringer bail to squeeze out the mop swab.

Heretofore, it was not possible to use a conventional side press wringer to squeeze out a wall washing pad while the pad was attached to its holder unless special metal inserts were first placed in the wringer. Moreover, it was generally not possible at all to squeeze out such a pad while attached to its holder using a conventional down press wringer. Accordingly, the wall washing pad had to be removed from the holder head, and a sponge or similar object had to be placed in the down press wringer bail under the pad so that the pad could be wrung out. Then the pad had to be reattached to the holder head.

SUMMARY OF THE INVENTION

With the foregoing in mind, it is a principal object of this invention to provide a wall washing pad holder which permits use of either a side press or down press mop wringer of conventional type to wring out a wall washing pad or the like attached thereto without having to place special inserts or other objects in the wringer, and without having to remove the pad from the holder head. This has the advantage that no special equipment is required to wring out the pad. Also, the operator does not have to remove the pad from the holder head every time he wants to wring out the pad and then replace the pad on the holder head.

In accordance with one aspect of the invention, the wall washing pad holder includes a generally flat rectangular mounting plate or head having a bottom or front side to which the wall washing pad is attached and a top or back side having ribs extending substantially perpendicular therefrom. The ribs terminate in a common plane substantially parallel to the planar bottom side of the mounting plate or head to provide for the transfer of pressure from the wringer plates to the pad through the ribs to wring out the pad.

In accordance with another aspect of the invention, the ribs provide for the recess mounting of a hinge member to the back side of the mounting plate or head. Pivotally connected to the hinge member is a handle socket. The hinge member permits the handle socket and handle connected thereto to be pivoted up against the back side of the mounting plate below the tops of the ribs so that the handle socket does not interfere with the pressure engagement of the wringer plates with the ribs and pad, respectively, during wringing out of the pad.

In accordance with still another aspect of the invention, there are a plurality of such ribs spaced apart on the back side of the mounting plate to distribute the applied pressure of the wringer plates over substantially the entire front side of the mounting plate during wringing out of the pad.

In accordance with a further aspect of the invention, the ribs are open or slotted at least at one end to permit water to flow freely between the ribs and back into a mop bucket or the like during wringing out of the pad.

To the accomplishment of the foregoing and related ends, the invention, then, comprises the features hereinafter fully described and particularly pointed out in the claims. The following description and the annexed drawings setting forth in detail a certain illustrative embodiment of the invention, this being indicative, however, of but one of the various ways in which the principles of the invention may be employed.

DETAILED DESCRIPTION OF THE PREFERRED EMBODIMENT

Figure 1:
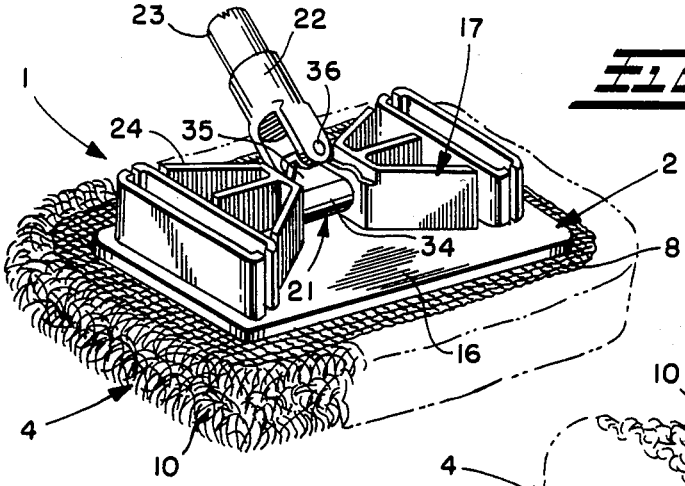
FIG. 1 is a fragmentary perspective view of a preferred form of a wall washing pad holder in accordance with the present invention.
Figure 2:
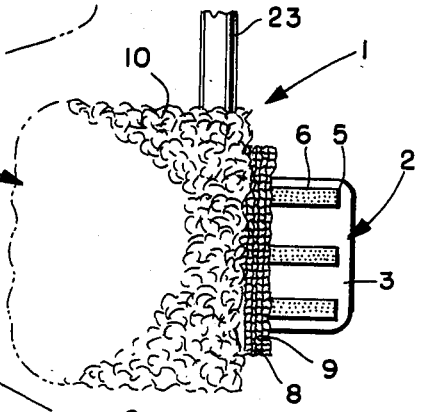
FIG. 2 is a fragmentary bottom plan view of the holder of FIG. 1 with a portion of the pad broken away to show one way of removably attaching the pad to the holder head.
Figure 3:
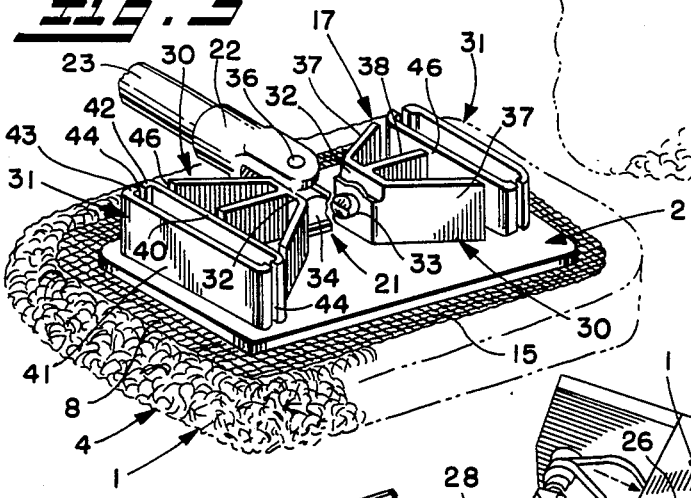
FIG. 3 is a fragmentary perspective view similar to FIG. 1, but showing the handle socket pivoted up against the back side of the mounting plate and having a portion of the hinge member for the handle socket broken away to show the pivotal mount therefor.

Referring now in detail to the drawings, and initially to FIGS. 1 through 3 thereof, there is shown a preferred form of wall washing pad holder 1 in accordance with this invention. The holder 1 includes a generally flat rectangular mounting plate or head 2 having a front or bottom side 3 to which a pad 4 may be attached in conventional manner. In the embodiment shown herein, three plastic strips 5 each having a plurality of flexible hooks 6 extending outwardly therefrom are provided for releasably engaging the pad. The plastic strips may be adhesively attached to the bottom side of the holder head 2 in spaced apart relation as shown in FIG. 2 and then permanently secured in place as by plastic welding the strips to the holder head.

The pad may be of conventional type including a generally rectangular support member 8 made of a suitable fabric material. Attached to the front face 9 of the support member are a plurality of yarns 10, which may be similar to mop yarn. The pad is primarily intended for use in washing walls and the like. However, such a pad can also be effectively used for cleaning carpet on stairways and other small carpeted areas, for applying floor finish in small or obstructed areas, or for applying cleaner/ treatment to wood paneling and the like. Other uses include a wide variety of dusting jobs, van washing, equipment scrub-down, window washing, etc. Also, various types of synthetic cleaning pads may be attached to the holder in place of the yarn pad to permit its use in cleaning baseboards or stripping finish from along walls or other areas where build-up occurs.

Regardless of the type of pad used, the fabric support member 8 is desirably somewhat larger than the holder head 2 and includes a fibrous backing 15 opposite the front side 9 which is engageable by the hooks 6 on the holder head for securely attaching the pad to the holder while at the same time permitting the pad to be readily pulled off by hand for laundering and/or replacement as necessary. Alternatively, other suitable means such as ties sewn or otherwise attached to the back face of the pad may be used to secure the pad to the holder.

Extending substantially perpendicular from the back side 16 of the holder head 2 are a plurality of spaced apart ribs 17. The holder head 2 is desirably made of a suitable plastic material as are the ribs 17 which are preferably molded as an integral part thereof. The ribs 17 are of considerable height in relation to the thickness of the holder head and terminate in a common plane which is substantially parallel to the planar front side 3 of the holder head, whereby when the holder head with pad attached thereto is inserted into a mop wringer of conventional type, the squeezing force of the wringer plates will be transmitted through the ribs to squeeze out the pad as described hereafter.

Figure 4:
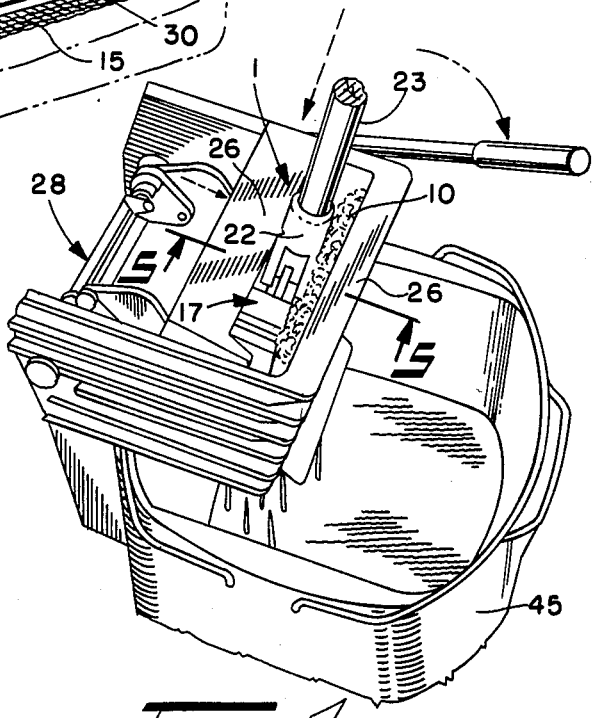
FIG. 4 is a fragmentary perspective view showing the wall washing pad holder with pad attached thereto being wrung out in a mop wringer of conventional type.
Figure 5:
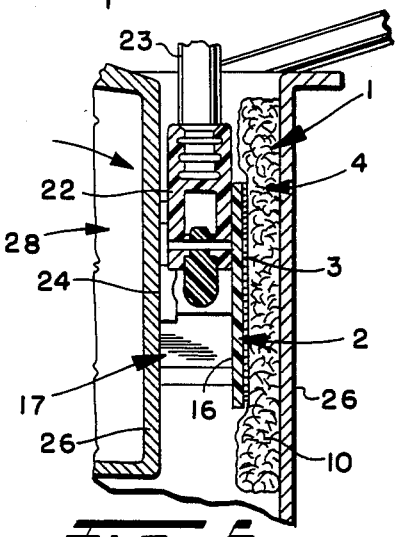
FIG. 5 is a fragmentary transverse section through the pad holder and mop wringer of FIG. 1 to show how the pressure from the wringer plates is transferred to the pad through the ribs without interference from the handle socket.

Preferably, the ribs 17 extend over substantially the full length and width of the back side of the holder head except in the center thereof which is left open to provide a recess 21 between the ribs for the recess mounting of a handle socket 22 therebetween. The handle socket 22 may have a threaded opening in the outer end for threaded receipt of a handle 23 and is pivotally connected to the back side of the holder head a sufficient distance below the tops 24 of the ribs 17 such that when the handle socket is pivoted up against such back side as shown in FIGS. 3 through 5, the handle socket will be below the tops of such ribs. When thus positioned, the handle socket and handle will not interfere with the pressure engagement of the wringer plates 26 with the ribs 17 and pad 4 during wringing out of the pad when the holder head with pad mounted thereon is inserted into a mop wringer 28 of conventional type as shown in FIGS. 4 and 5.

Preferably, there are two sets 30, 31 of ribs 17 symmetrically oriented with respect to the transverse center of the holder head. The first set 30 of ribs each include a transversely extending end wall 32 having a stub shaft 33 extending toward the transverse center of the holder head for engagement by the ends of a hinge member 34 which is pivotally mounted thereon (see FIGS. 1 and 3). Extending outwardly from the hinge member 34 is a mounting flange 35 to which the handle socket 22 may also be pivotally connected as by means of a hinge pin 36 which lies in a plane substantially normal to the pivotal axis of the hinge member 34. Accordingly, the handle socket 22 and handle 23 threadedly connected thereto are free to be rotated in a transverse plane between the rib end walls 32 and also in a longitudinal plane about hinge pin 36, whereby the handle may be universally pivoted to substantially any desired position.

Extending outwardly in opposite directions from the opposite ends of the respective end walls 32 are a pair of outwardly angled rib members 37, with a central rib member 38 extending from the respective end walls between the angled rib members 37. The pin connection 36 between the hinge member 34 and handle socket 22 is located radially outwardly from such hinge member a distance somewhat greater than the vertical height of the ribs 17 from such hinge member and also radially outwardly a distance greater than the distance between the ends of the end walls 32 and such hinge member, whereby regardless of the angular position of the hinge member with respect to the holder head, the handle socket 22 may be pivoted by an amount at least equal to the slope of the angled rib members 37 (in this case 60° in either direction from the transverse center) when the handle socket extends at an angle below the height of the ribs and at least 90° when the handle socket extends at an angle above the height of the ribs.

Adjacent the axial outer ends of each of the first set 30 of ribs 17 is a second set 31 of ribs, each of which consists of a pair of axially spaced apart, transversely extending rib members 40, 41. Such rib members desirably have inturned ends 42, 43 facing each other but slightly spaced apart to provide slots 44 between the ends thereof for the escape of water from between the rib members and return to the wringer bucket 45 as the pad is being wrung out. Likewise, the axial outer ends of the rib members 37, 38 of each of the first set 30 of ribs are desirably open, and there is a space between the outer ends of the rib members 37, 38 of each first set and the adjacent rib member 40 of the second set to provide slots 46 therebetween for the escape of water. Such a rib arrangement substantially reduces the amount of plastic material in the holder, thus reducing the cost and weight thereof, while at the same time providing for the relatively uniform distribution of the pressure that is applied thereto by the wringer plates over substantially the entire surface of the holder head during wringing out of the pad.

Although the dimensions of the wall washing pad holder 1 may vary depending on the particular application, a typical holder in accordance with this invention may have a mounting plate or head 2 which is approximately 3/32" thick, approximately $4\frac{5}{8}$" wide, and approximately 7" long. Also, the ribs 17 may have a vertical height of approximately $1\frac{7}{8}$", and the end walls 32 may have a length of approximately $\frac{3}{4}$" , with the stub shafts 33 for the hinge member 34 being located intermediate the ends of such end walls 32 and spaced approximately $\frac{1}{2}$" above the back side of the holder head. The hinge pin 36 for pivotally connecting the handle socket 22 to the hinge member 34 may be located approximately $\frac{3}{4}$" outwardly from the pivotal axis of the hinge member. The spacing between the end walls 32 may be approximately $1\frac{7}{8}$". The included angle between the rib members 37 is desirably approximately 60°. Also, the angled rib members 37 may have a length of approximately $1\frac{3}{4}$"; the central rib members 38 a length of approximately $1\frac{1}{2}$, and the transversely extending rib members 41, 42 a length of approximately 3". The clearance space 46 between the axial outer ends of the rib members 37, 38 and the adjacent rib member 40 is desirably approximately $\frac{1}{4}$", and the clearance space 44 between the inturned ends of the transversely extending rib members 40, 41 is approximately $\frac{1}{8}$". When the handle socket 22 is pivoted up against the back side of the holder head, the ribs 17 desirably extend above the handle socket 22 a distance of approximately $\frac{1}{8}$".

Although the invention has been shown and described with respect to a certain preferred embodiment, it is obvious that equivalent alterations and modifications will occur to others skilled in the art upon the reading and understanding of the specification. The present invention includes all such equivalent alterations and modifications and is limited only by the scope of the claims.

What is claimed is:

1. A pad holder comprising a generally flat rectangular mounting plate having a front side to which a pad is adapted to be attached, and a back side opposite said front side, said back side having rib means extending outwardly therefrom, said rib means terminating in a common plane substantially parallel to the front side of said mounting plate, a handle attachment, and means pivotally connecting said handle attachment to the back side of said mounting plate below the outer ends of said rib means, said handle attachment being moveable to a position inwardly of said outer ends of said rib means, thereby permitting said mounting plate with pad attached thereto to be inserted into a mop wringer of conventional type for wringing out of the pad, said means pivotally connecting said handle attachment comprising a hinge connection between said handle attachment and said rib means below the outer ends of said rib means, said rib means extending substantially the full length and width of the back side of said mounting plate except in the center thereof which is left open to provide a recess for the recess mounting of said hinge member below the outer ends of said rib means.

2. The pad holder of claim 1 wherein said rib means includes a pair of spaced apart transversely extending end walls each having stub shafts extending therefrom toward each other for pivotal engagement by the ends of said hinge member.

3. The pad holder of claim 2 wherein said rib means further comprises a pair of angled rib members extending outwardly at an angle in opposite directions from each of said end walls.

4. The pad holder of claim 3 wherein said rib means further comprises a central rib member extending from each of the respective end walls between said angled rib members.

5. The pad holder of claim 4 wherein said rib means further comprises a pair of spaced apart transversely extending rib members adjacent the outer ends of said angled rib members and central rib member.

6. The pad holder of claim 5 wherein said transversely extending rib members have inturned ends facing each other, said inturned ends being spaced apart to provide water drainage slots therebetween.

7. The pad holder of claim 6 wherein the outer ends of said angled rib members and central rib members are open, and there is a space between said outer ends and the adjacent transversely extending rib member to provide water drainage slots therebetween.

8. A wall washing pad holder comprising a mounting plate having a generally flat front side for attachment of a pad thereto, and a back side having a plurality of ribs extending substantially perpendicular therefrom, said ribs having radial outer ends terminating in a common plane substantially parallel to the front side of said mounting plate, a handle attachment, and means pivotally connecting said handle attachment to said back side of said mounting plate inwardly of the radial outer ends of said ribs, said handle attachment being mounted for pivotal movement up against the back side of said mounting plate and inwardly of the radial outer ends of said ribs, said ribs including a pair of spaced apart transversely extending end walls, and said handle attachment being pivotally connected between said end walls, said end walls having axially inwardly facing sides from which stub shafts project toward each other and radial outer ends, and said handle attachment including a hinge member having opposite axial ends pivotally connected to said stub shafts below the radial outer ends of said end walls, said end walls also having axial outwardly facing sides from which extend in opposite directions a plurality of ribs generally perpendicular to the back side of said mounting plate, said plurality of ribs having axial outer ends spaced from said axial outer sides of said end walls, and at least one rib extending transversely across substantially the full width of said mounting plate adjacent the axial outer ends of said plurality of ribs extending from the axial outer sides of said end walls.

9. The holder of claim 8 wherein there are three ribs extending from the axial outer side of each of said end walls, two of said ribs extending at an angle away from each other from the axial ends of each of said end walls, and one of said ribs extending between said angled ribs.

10. The holder of claim 8 wherein there are a pair of spaced apart transversely extending ribs adjacent the axial outer ends of said ribs extending from each of said end walls, said transversely extending ribs having axial inturned ends facing each other and spaced apart to provide water drainage slots therebetween.

11. The holder of claim 10 wherein the axial outer ends of said ribs extending from each of said end walls are open, and there is a space between said axial outer ends and the adjacent transversely extending rib to provide water drainage slots therebetween.

12. A pad holder comprising a generally flat rectangular mounting plate having a front side to which a pad is adapted to be attached, and a back side opposite said front side, said back side having rib means extending outwardly therefrom, said rib means terminating in a common plane substantially parallel to the front side of said mounting plate, a handle attachment, and means pivotally connecting said handle attachment to the back side of said mounting plate below the outer ends of said rib means, said handle attachment being movable to a position inwardly of said outer ends of said rib means, thereby permitting said mounting plate with pad attached thereto to be inserted into a mop wringer of conventional type for wringing out of the pad, said means pivotally connecting said handle attachment comprising a hinge connection between said handle attachment and said rib means below the outer ends of said rib means, said handle attachment comprising a hinge member pivotally mounted between portions of said rib means below the outer ends of said rib means, and a handle socket pivotally connected to said hinge member radially outwardly of said rib means, the pivotal connection between said handle socket and hinge member lying in a plane substantially normal to the pivotal axis of said hinge member.

13. A wall washing pad holder comprising a mounting plate having a generally flat front side for attachment of a pad thereto, and a back side having a plurality of ribs extending substantially perpendicular therefrom, said ribs having outer ends terminating in a common plane substantially parallel to the front side of said mounting plate, a handle attachment, and means pivotally connecting said handle attachment to said back side of said mounting plate inwardly of the outer ends of said ribs, said handle attachment being mounted for pivotal movement up against the back side of said mounting plate and inwardly of the outer ends of said ribs, said ribs including a pair of spaced apart transversely extending end walls, and said handle attachment being pivotally connected between said end walls, said end walls having stub shafts projecting therefrom toward each other, and said handle attachment including a hinge member having opposite ends pivotally connected to said stub shafts below the outer ends of said ends walls, and a handle socket pivotally connected to said hinge member radially outwardly of said ribs, the pivotal connection between said handle socket and hinge member lying in a plane substantially normal to the pivotal axis of said hinge member.

* * * * *